US009090519B1

(12) United States Patent
Hawkins et al.

(10) Patent No.: US 9,090,519 B1
(45) Date of Patent: Jul. 28, 2015

(54) GREEN HYPERGOLIC FUELS

(75) Inventors: Tommy W. Hawkins, Lancaster, CA (US); Stefan Schneider, Palmdale, CA (US); Michael Rosander, Lancaster, CA (US); Leslie Hudgens, Lancaster, CA (US)

(73) Assignee: The United States of America as represented by the Secretary of the AirForce, Washington, DC (US)

( * ) Notice: Subject to any disclaimer, the term of this patent is extended or adjusted under 35 U.S.C. 154(b) by 237 days.

(21) Appl. No.: 13/107,488

(22) Filed: May 13, 2011

Related U.S. Application Data

(60) Provisional application No. 61/355,598, filed on Jun. 17, 2010.

(51) Int. Cl.
*C06B 47/00* (2006.01)
*C06B 43/00* (2006.01)

(52) U.S. Cl.
CPC ..... *C06B 47/00* (2013.01); *C06B 43/00* (2013.01)

(58) Field of Classification Search
CPC ..... C06B 47/00; C06B 43/00
USPC ..... 149/1, 22
See application file for complete search history.

(56) References Cited

U.S. PATENT DOCUMENTS

| | | | | |
|---|---|---|---|---|
| 3,552,127 | A | 1/1971 | Morrell | |
| 5,932,837 | A | 8/1999 | Rusek et al. | |
| 6,045,638 | A * | 4/2000 | Lundstrom | 149/36 |
| 6,218,577 | B1 | 4/2001 | Brand et al. | |
| 6,378,291 | B1 | 4/2002 | Schneider | |
| 6,588,199 | B2 | 7/2003 | Stechman, Jr. et al. | |
| 6,695,938 | B2 | 2/2004 | Diede | |
| 2003/0192663 | A1 | 10/2003 | Diede | |
| 2004/0221933 | A1 | 11/2004 | Hallit et al. | |
| 2005/0022911 | A1 | 2/2005 | Rusek et al. | |
| 2005/0269001 | A1 * | 12/2005 | Liotta et al. | 149/1 |
| 2006/0041175 | A1 * | 2/2006 | Thorn et al. | 570/123 |

OTHER PUBLICATIONS

United States Patent and Trademark Office, Third Non-Final Office Action in related U.S. Appl. No. 10/816,032, mailed Mar. 25, 2011, 7 pages total.
United States Patent and Trademark Office, Second Non-Final Office Action in related U.S. Appl. No. 12/567,136, mailed Dec. 10, 2012, 10 pages total.
United States Patent and Trademark Office, Second Advisory Action in related U.S. Appl. No. 12/567,136, mailed Mar. 2, 2012, 3 pages total.
United States Patent and Trademark Office, First Advisory Action in related U.S. Appl. No. 12/567,136, mailed Jan. 11, 2012, 2 pages total.
United States Patent and Trademark Office, First Final Office Action in related U.S. Appl. No. 12/567,136, mailed Dec. 28, 2011, 9 pages total.
United States Patent and Trademark Office, First Non-Final Office Action in related U.S. Appl. No. 12/567,136, mailed Sep. 15, 2011, 7 pages total.
United States Patent and Trademark Office, Second Advisory Action in related U.S. Appl. No. 10/816,032, mailed Dec. 13, 2011, 2 pages total.
United States Patent and Trademark Office, Third Final Office Action in related U.S. Appl. No. 10/816,032, mailed Sep. 29, 2011, 7 pages total.
United States Patent and Trademark Office, Second Final Office Action in related U.S. Appl. No. 10/816,032, mailed Oct. 26, 2009, 6 pages total.
United States Patent and Trademark Office, Final Office Action in related U.S. Appl. No. 12/567,136, mailed May 20, 2013, 10 pages total.
United States Patent and Trademark Office, Second Non-Final Office Action in related U.S. Appl. No. 10/816,032, mailed Apr. 13, 2009, 6 pages total.
United States Patent and Trademark Office, First Advisory Action in related U.S. Appl. No. 10/816,032, mailed Dec. 16, 2008, 3 pages total.
United States Patent and Trademark Office, First Non-Final Office Action in related U.S. Appl. No. 10/816,032, mailed May 3, 2007, 4 pages total.
United States Patent and Trademark Office, First Final Office Action in related U.S. Appl. No. 10/816,032, mailed Oct. 27, 2008, 5 pages total.
United States Patent and Trademark Office, Second Non-Final Office Action in related U.S. Appl. No. 12/567,110, mailed Dec. 3, 2012, 11 pages total.
United States Patent and Trademark Office, Second Advisory Action in related U.S. Appl. No. 12/567,110, mailed Mar. 1, 2012, 3 pages total.
United States Patent and Trademark Office, First Advisory Action in related U.S. Appl. No. 12/567,110, mailed Jan. 11, 2012, 2 pages total.
United States Patent and Trademark Office, First Final Office Action in related U.S. Appl. No. 12/567,110, mailed Dec. 28, 2011, 10 pages total.
United States Patent and Trademark Office, First Non-Final Office Action in related U.S. Appl. No. 12/567,110, mailed Sep. 16, 2011, 8 pages total.
S. Schneider et al., "Ionic liquids as hypergolic fuels," Energy & Fuels, vol. 22 (2008) 2871-2872.
S. D. Chambreau et al., "Fourier transform infrared studies in hypergolic ignition of ionic liquids," J. Phys. Chem. A., vol. 112 (2008) 7816-7824.
S. Schneider et al., Preprint of "Liquid azide salts and their reactions with common oxidizers IRFNA and N2O4," which was published in Inorg. Chem., vol. 47 (2008) 6082-6089.
R. Wang et al., "Furazan-functionalized tetrazolate-based salts: a new family of insensitive energetic materials," Chem. Eur. J., vol. 15 (2009) 2625-2634.
United States Patent and Trademark Office, Final Office Action in related U.S. Appl. No. 12/567,110, mailed Jun. 5, 2013, 10 pages.
United States Patent and Trademark Office, Final Office Action in related U.S. Appl. No. 10/816,032, mailed Jun. 7, 2013, 8 pages.

* cited by examiner

*Primary Examiner* — Aileen B Felton
(74) *Attorney, Agent, or Firm* — AFMCLO/JAZ; Chastity Whitaker

(57) ABSTRACT

Provided is an ionic liquid (IL) having anions and cations with a metalohydride in the IL of borohydrides and/or aluminum hydrides, as fuel and a choice of one or more oxidizers, which fuel and oxidizer have hypergolic tendencies.

15 Claims, No Drawings

GREEN HYPERGOLIC FUELS

CROSS REFERENCE TO RELATED APPLICATION

This application claims priority of the filing date of provisional application Ser. No. 61/355,598 filed Jun. 17, 2010.

STATEMENT OF GOVERNMENT INTEREST

The invention described herein may be manufactured and used by or for the Government for governmental purposes without the payment of any royalty thereon.

FIELD OF THE INVENTION

This invention relates to hypergolic fuels, particularly those having components of little or no toxicity.

BACKGROUND OF THE INVENTION

The state-of-the-art, storable bipropulsion system uses a hydrazine (typically monomethylhydrazine) as a fuel component. This fuel affords useful performance characteristics and has a fast ignition with an oxidizer. Such fast (hypergolic) ignition provides system reliability for on-demand action of the propulsion system. In addition, a bipropellant's hypergolic character is very beneficial since it removes the requirement of a separate ignition component; additional components bring increased inert mass and reduced system performance. The energy density of the state-of-the-art, storable bipropulsion system is largely limited by the density of the fuel. Storable fuels range in density from 0.88 g/cc (monomethylhydrazine) to 1.00 g/cc (hydrazine). Energetic ionic liquids have established densities that range well above 1.00 g/cc, and thus can confer greater energy density as bipropellant fuels. Also, there are significant costs and operational constraints associated with handling state-of-the-art fuels (hydrazines) that derive from the fuel's carcinogenic vapor. Fuel transport, loading and unloading are significantly complicated by its vapor toxicity and can require considerable efforts and costs in vapor monitoring with trained operations crews employed in expensive personal protection equipment.

Accordingly there is need and market for environmentally enhanced "green" fuels, which overcome the above prior art shortcomings.

SUMMARY OF THE INVENTION

Broadly, the present invention provides a bipropellant having, an ionic liquid (IL) containing a metalohydride as fuel and an oxidizer, which fuel and oxidizer have hypergolic ignition upon contact.

In one embodiment, the above IL has an anion and cation, with the metalohydride being situated in the anion.

DESCRIPTION OF PREFERRED EMBODIMENTS

Referring to the present invention in detail, advanced IL fuels with fast ignition (upon mixing with storable oxidizer), have been synthesized per the invention. Principally, such fuels are based upon ionic liquids containing borohydride including anions with borohydride as a structural component or other metallohydrides. That is, borohydrides and substituted borohydride anions of the formula:

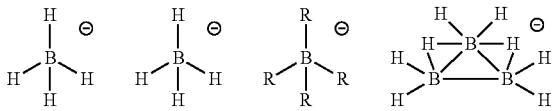

where R is as noted below.

The borohydride anions of the present invention include unsubstituted $BH_4$-and mono-, di-, tri-and tetra-substituted borohydride anions in which the substituted, R-groups can be nitriles, alkyls, or ethers or a combination thereof. Also, stable polyborohydrides such as octahydrotriborate can be utilized.

Further suitable metalohydride anions have the formula:

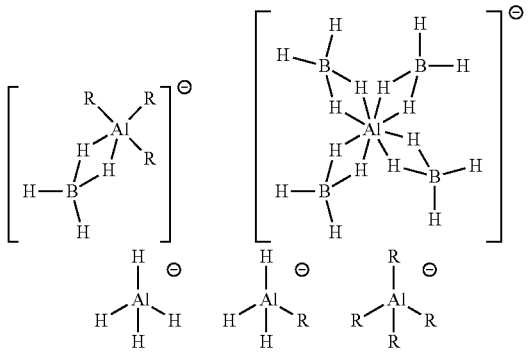

where R is as noted below.

The metalohydride anion structures shown above include hydrides containing both aluminum and boron. Additionally, unsubstituted and mono-, di-,tri- and tetra-substituted aluminum hydrides are employable in which the substituted, R-groups can be nitriles, alkyls or ethers or a combination thereof.

In addition to the anion, the ionic liquid must contain a cation with a structure that resists reduction by the anion. Stability dictates the cation should not be the protonated form of a free base, and greater stability is found with cations that are free of carbonyl and functionalities containing the iminium group. Thus, cations can be selected from open chain substituted ammonium, substituted pyrrolidinium, piperidinium, tetrazolium or imidazolium groups as shown in the formulas below:

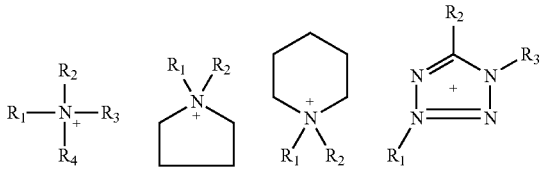

where $R_1$, $R_2$, $R_3$, $R_4$ can be equivalent or different in structure and are selected from hydrogen, cyano-, alkyl substituted amino, azido, hydroxyl, halide, C1—C18 hydrocarbon chains, or C1—C18 hydrocarbon chains containing cyano-, alkyl substituted amino, azide, hydroxyl, halide, nitrato-, nitro-, nitramino-, amido-,amidino-, hydrazino- chemical functionalities.

The determination of reactivity of borohydride-based ionic liquids with white fuming nitric acid (WFNA), nitrogen tetroxide and hydrogen peroxide (both 90% and 97%) was performed. The experimental results are shown in the table below. Fast ignition is generally observed with these ionic liquid fuels upon contact with the liquid oxidizer.

TABLE 1

IGNITION RESPONSE OF IONIC LIQUID-BASED FUELS WITH WHITE FUMING NITRIC ACID, NITROGEN TETROXIDE AND HYDROGEN PEROXIDE

| compound | WFNA | N2O4 | H2O2 |
|---|---|---|---|
| 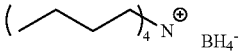 | Ignition | Ignition | Ignition (90% $H_2O_2$) |
| BMIM BH4 | Ignition | Ignition | Ignition (90% $H_2O_2$) |
| 75% BMIM BH4<br>25% EMIM B(CN)4<br>Mixture | Ignition | Ignition | Ignition (97% $H_2O_2$) |
| (in propylamine) 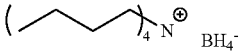 | TBD | TBD | Ignition (97% $H_2O_2$) |
| 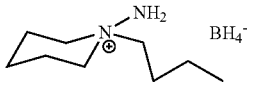 | TBD | TBD | Ignition (97% $H_2O_2$) |
| 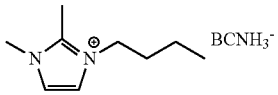 | Ignition | Ignition (on 2nd drop) | No Ignition (97% $H_2O_2$) |

In the preferred embodiment of the invention, both the cation and anion structures are chosen to confer low melting points and low viscosity, while also incorporating structures that increase heat of combustion of the fuel with the storable liquid oxidizer. Such substituent (i.e., R-group) structures may be strained-ring (e.g., cyclopropyl-), or high-nitrogen moieties (e.g., azido-or cyano).

Ionic liquids have established characteristics of negligible vapor toxicity and generally higher density than typical propulsion fuels (e.g., hydrocarbons and hydrazines). The design and development of energy-dense, fast-igniting ionic liquids as fuels for bipropellants can provide improved handling characteristics (due to lower toxicity hazard) and thus lower operations cost. In addition, such fuels can impart greater performance capabilities such as increased velocity, range or system lifetime.

Advanced bipropellant fuels are designed for fast ignition, upon mixing with storable oxidizer ($N_2O_4$, nitric acid and hydrogen peroxide) and have been synthesized per the invention. The bipropellant fuels are based upon salts, particularly ionic liquids, containing borohydride-based anions and employ cations designed to impart low melting point, stable molecules.

Fast igniting, ionic liquid fuels provide a means to overcome significant limitations of a state-of-the-art, storable bipropulsion system. Such ionic liquid fuels can provide greater than 20% improvement in density over hydrazine fuels. This confers greater energy density to the bipropulsion system. Also, the negligible vapor pressure of ionic liquid fuel provides an outstanding means of significantly reducing costs and operational constraints associated with handling the fuel. Prior to this invention, fast-igniting ionic liquid fuels were limited to operation with oxidizers based solely on oxides of nitrogen (e.g., NTO/WFNA/RFNA/IRFNA) as the only suitable oxidizers. The discovery of hypergolic activity of metalohydride-based ILs in combination with stabilizing cations, affords a new class of IL-based fuel that provides fast ignition with not only oxides of nitrogen but also with hydrogen peroxide. The employment of a fast-igniting ionic liquid fuel with hydrogen peroxide oxidizer, provides an avenue toward a bipropulsion system that employs environmentally enhanced (or green) fuel and oxidizer.

The preferred embodiment of the invention is the employment of pure borohydride-based IL fuel as a fast-igniting, bipropellant. However, the use of these ionic liquid molecules as components in fuel mixtures to confer fast-ignition and density, is also a viable mode of the invention.

A hypergolic bipropellant based upon an ionic liquid, borohydride-based fuel and an oxidizer ($H_2O_2$/NTO/WFNA/RFNA/IRFNA) has potential as a replacement for bipropellants currently used in on-orbit spacecraft propulsion. Other application areas include liquid engines for boost and divert propulsion. The high energy density that is inherent in the new hypergol, lends itself to applications that require high performance from volume limited systems. The low vapor toxicity of the ionic liquid fuel is a benefit over toxic hydrazine fuels currently used.

Also, the performance aspects of this new hypergol can find use in commercial applications in satellite deployment and commercial space launch activities.

What is claimed is:

1. a bipropellant comprising, an ionic liquid comprising an anion and a cation, the anion including a metalohydride; and an oxidizer.

2. The bipropellant claim 1, wherein the metalohydride is selected from the group consisting of borohydrides and aluminum hydrides.

3. The bipropellant of claim 2, wherein the metalohydride is a borohydride selected from the group consisting of a $BH_4$ anion, a mono-substituted borohydride anion, a di-substituted borohydride anion, a tri-substituted borohydride anion, and a tetra-substituted borohydride anion.

4. The bipropellant of claim 2, wherein the metalohydride is a polyborohydride.

5. The bipropellant of claim 4, wherein the polyborohydride is octahydrotriborate.

6. The bipropellant of claim 2, wherein the metalohydride is a borohydride having the structure:

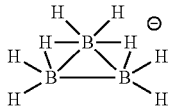

7. The bipropellant of claim 2, wherein the metalohydride is a aluminum hydride anion.

8. The bipropellant of claim 7, wherein the aluminum hydride anion has a structure selected from the group consisting of:

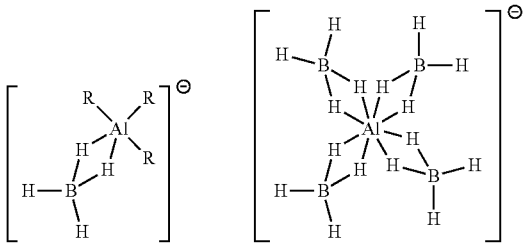

-continued

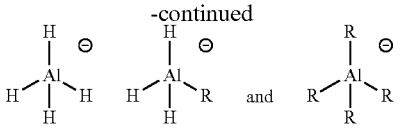

and R is a nitrile, an alkyl, or an ether.

9. The bipropellant of claim 1, wherein the cation is an open chain substituted ammonium.

10. The bipropellant of claim 9, wherein the open chain substituted ammonium has a structure selected from the group consisting of:

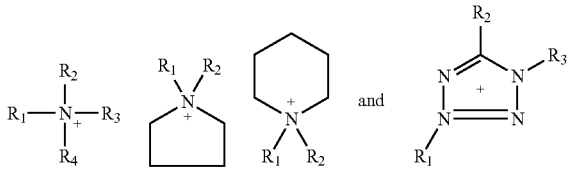

and each of the $R_1$, $R_2$, $R_3$, $R_4$ ligands may be selected from the group consisting of hydrogen, cyano-, alkyl substituted amino, azido, hydroxyl, halide, a C1—C18 hydrocarbon chain.

11. The bipropellant of claim 1, wherein the oxidizer is an oxide of nitrogen.

12. The bipropellant of claim 11, wherein oxide of nitrogen is selected from the group consisting of nitrogen tetraoxide, white fuming nitric acid, red fuming nitric acid, and inhibited red fuming nitric acid.

13. The bipropellant of claim 1, wherein the cation is selected from the group consisting of a pyrrolidinium, a piperidinum, a tetrazolium, and an imidazolium.

14. The bipropellant of claim 10, wherein the C1—C18 hydrocarbon chain includes a cyano-functional, an alkyl substituted amino functionality, an azide functionality, a hydroxyl functionality, a halide functionality, a nitrato-functionality, a nitro-functionality, a nitramino-functionality, an amido-functionality, an amidino-functional, a hydrazino-functionality, or a combination thereof.

15. The bipropellant of claim 1, wherein the oxidizer is hydrogen peroxide.

* * * * *